US005527209A

United States Patent [19]

Volodarsky et al.

[11] Patent Number: 5,527,209

[45] Date of Patent: Jun. 18, 1996

[54] WAFER POLISHER HEAD ADAPTED FOR EASY REMOVAL OF WAFERS

[75] Inventors: Konstantine Volodarsky, San Francisco; Jiro Kajiwara, Foster City; Herbert W. Owens, Jr., San Jose; Jan H. King, Sunnyvale, all of Calif.

[73] Assignee: Cybeq Systems, Inc., Menlo Park, Calif.

[21] Appl. No.: 449,556

[22] Filed: May 24, 1995

Related U.S. Application Data

[63] Continuation of Ser. No. 119,972, Sep. 9, 1993, Pat. No. 5,443,416.

[51] Int. Cl.[6] ..... B24B 47/00

[52] U.S. Cl. ..... 451/388; 451/283; 451/41

[58] Field of Search ..... 451/41, 42, 388, 451/390, 397, 398, 402, 384, 385

[56] References Cited

U.S. PATENT DOCUMENTS

| | | | |
|---|---|---|---|
| 3,731,435 | 5/1973 | Boettcher et al. | 51/129 |
| 4,009,539 | 3/1977 | Day | 51/131 |
| 4,193,226 | 3/1980 | Gill, Jr. et al. | 51/124 |
| 4,194,324 | 3/1980 | Bonora et al. | 51/131.5 |
| 4,270,316 | 6/1981 | Kramer et al. | 51/283 |
| 4,519,168 | 5/1985 | Cesna | 51/216 LP |
| 4,680,893 | 7/1987 | Cronkhite et al. | 51/5 R |
| 4,918,870 | 4/1990 | Torbert et al. | 51/131.3 |
| 5,081,795 | 1/1992 | Tanaka et al. | 51/131.1 |
| 5,205,082 | 4/1993 | Shendon et al. | 51/283 |

FOREIGN PATENT DOCUMENTS

| | | |
|---|---|---|
| 0383910 | 2/1988 | European Pat. Off. . |
| 221307 | 4/1985 | Germany . |
| 58-022657A | 2/1983 | Japan . |
| 59-124536A | 7/1984 | Japan . |
| 59-166460A | 9/1984 | Japan . |
| 60-157231 | 8/1985 | Japan . |
| 62-124844A | 6/1987 | Japan . |
| 62-297063A | 12/1987 | Japan . |
| 2054765 | 2/1990 | Japan . |
| 3121778 | 5/1991 | Japan . |
| 3173129A | 7/1991 | Japan . |
| 3278434 | 12/1991 | Japan . |
| 4019065A | 1/1992 | Japan . |

OTHER PUBLICATIONS

RD 322024 Feb. 1991 Anonymous Research Disclosure filed with the U.S. Patent and Trademark Office.

*Primary Examiner*—Bruce M. Kisliuk
*Assistant Examiner*—Derris Banks
*Attorney, Agent, or Firm*—Flehr, Hohbach, Best, Albritton & Herbert

[57] ABSTRACT

Device is described that reduces the forces needed to release a wafer from a wet polishing surface after polishing. Device comprises attachment adapted to be mounted to a polishing apparatus to permit attachment surface, configured to mate with two regions of the wafer, to tilt relative to the polishing surface. Means for defining adhesive force between attachment surface and one of the two wafer regions, and means for defining adhesive force between attachment surface and other of the two wafer regions which is different than that defined between attachment surface and the one wafer region so as to cause a non-parallel relationship between the one wafer face and polishing surface, are provided. Unbalanced force causes a non-parallel relationship between wafer and polishing pad and facilitates separation and lifting of wafer from polishing surface. Embodiments wherein attachment is a wafer carrier, and unbalanced adhesive force is a vacuum communicated to a limited region of the surface of the carrier by a plurality of fluid transport channels. Other embodiments include a mechanical lifting force to actively tilt surface, a pressurized fluid delivered to the attachment surface for separating the wafer and cleaning the attachment surface, and/or rotary union for coupling fluids between rotatable and nonrotatable portions of the device. Independent pressure chambers for controlling polishing pressure and the adhesion or release of the wafer may be provided.

26 Claims, 7 Drawing Sheets

WAFER POLISHER HEAD ADAPTED FOR EASY REMOVAL OF WAFERS

DISCLOSURE

This is a continuation of application Ser. No. 08/119,972 filed Sep. 9, 1993, which is now U.S. Pat. No. 5,443,416.

FIELD OF THE INVENTION

This invention relates to wafer polishing devices, and more particularly, to devices and methods for releasing a wafer from a polishing surface in a polishing device.

BACKGROUND OF THE INVENTION

Most conventional wafer polishing machines involve a table-type support having a rotatable polishing surface to which a polishing pad is mounted. The polishing pad is opposed by a rotatable polishing head to which a wafer carrier is mounted. The wafer is adhered to the carrier with the wafer face to be polished exposed. (In some prior patents or other publications, the carrier is referred to as a sub-carrier.) A wet polishing slurry, usually comprising a polishing abrasive suspended in a liquid, is applied to the polishing pad. The polishing head, including the carrier with adhered wafer, is moved to bring the exposed face of the wafer into contact with the wet polishing pad, for polishing. Downward polishing pressure is often applied between the rotating wafer and the rotating polishing pad during the polishing operation.

After the face of the wafer has been polished the wafer is picked up and removed from the wet polishing pad. It is desirable to have the wafer release from the polishing pad and remain attached to the carrier when the polishing head is lifted away from the polishing pad, without requiring the polished wafer face or the wafer edges to be contacted. Available materials and methods for adhering a wafer to a carrier do not always provide sufficient adhesion to reliably retain the wafer on the carrier against the strong adhesion between the wafer and the polishing pad.

The adhesive force between the wet pad and the wafer after polishing can be quite large even though the wafer is relatively lightweight. The smooth surface of the polished wafer, the presence of pores on the surface of many types of polishing pads which act as miniature suction devices, the presence of the fluid slurry which enhances the suction holding action of the pores, and the downward pressure often applied during polishing all tend to create a strong adhesion between the wafer and the polishing pad.

The conventional apparatus and methods do not provide sufficient adhesion between the carrier and the wafer to overcome the strong suction force holding of the polished wafer to the wet polishing pad, and the wafer undesirably remains adhered to the pad. When the wafer is not retained on the carrier, the wafer is usually manually removed from the polishing pad.

One conventional method of holding the wafer to the carrier uses an adhesive insert, such as a poromeric insert, between the carrier and the wafer. However, the adhesive force provided by such inserts may be insufficient to retain the wafer on the carrier. For example, some recently developed polishing pads, such as the IC1000 polishing pad made by Rodel (9495 East Salvador Drive, Scottsdale, Ariz., 85258), adhere the polished wafer to the pad particularly strongly after polishing and when one is used it is not unusual for a polished wafer to remain adhered to the pad when the polishing head is lifted away.

Heretofore, there have been some attempts to utilize a vacuum force, rather than an adhesive insert, to hold a wafer to a carrier. Japanese Patent JP 62-124844, for example, suggests the use of a vacuum holding force which is applied to a wafer through a porous ceramic carrier. The porous structure of the ceramic material communicates the vacuum pressure uniformly to a surface of the carrier that mates to a back face of the wafer. Patent JP 62-124844 also suggests the use of a pressurized fluid to release the wafer from the carrier. Other attempts to use vacuum force to adhere a wafer to a carrier have also been made. U.S. Pat. No. 4,193,226, for example, suggests the use of vacuum force applied to a wet absorbent material insert in contact with the entire wafer surface to adhere the wafer to the polishing head. It also suggests the use of positive fluid pressure including air and water to assist in releasing the wafer from the carrier.

The prior attempts to solve the problem of reliably releasing a wafer from a polishing surface and retaining it on the polishing head wafer carrier have not been entirely satisfactory because they do not provide for reliable release of the wafer from the pad and retention on the carrier. In particular, the prior solutions do not meet the needs of automated processing where robotics technology necessitates more reliable apparatus and methods for releasing the wafer from a wet polishing pad. Automation also requires the removal of polishing residues from the wafer carrier after each polishing operation so that the next wafer may be mounted without interference or distortion.

SUMMARY OF THE INVENTION

The present invention provides a device and method for use with a polishing apparatus having a wet polishing surface for polishing a semiconductor wafer face. During polishing, the wafer is oriented generally parallel to and in substantial contact with the polishing surface. After polishing, the wet polishing surface of such a polishing apparatus may strongly adhere the polished surface of the wafer and make wafer release and removal difficult.

A device according to the present invention is constructed in a manner that reduces the force needed to pick up the wafer from the wet polishing surface after polishing so that it may be more easily and reliably released and removed from the pad. It comprises an attachment adapted to be mounted to a polishing apparatus so as to permit an attachment surface defined by the same to tilt relative to the polishing surface. The attachment surface is configured to mate with at least two regions of the wafer. The two regions of the wafer are subjected to different adhesive forces when the wafer is picked up from the pad. Means for defining an adhesive force between the attachment surface and one of the two wafer regions is provided. Means for defining an adhesive force between the attachment surface and the other of the two wafer regions which is different than that defined between the attachment surface and the one wafer region so as to cause a differential adhesion between the one wafer face and the polishing surface, is also provided. The application of the different or unbalanced adhesive forces on the two regions of the wafer causes a non-parallel relationship between the wafer and the polishing pad and facilitates separation of the one wafer face from the polishing surface.

Most desirably, the means for defining an adhesive force between the attachment surface and the other region includes means to direct a vacuum provided by a vacuum source to the other of the two wafer regions. The means to direct the vacuum may desirably include a plurality of fluid transport channels which open within a limited region of the attachment surface.

Desirably, the attachment is a wafer carrier and the device also includes has means for exerting a mechanical lifting force to separate one portion of the carrier from the polishing surface while permitting another portion of the carrier to remain in contact with the polishing surface. This mechanical force actively causes the non-parallel relationship between the one wafer face and the polishing surface.

The invention also includes a device for use with a polishing apparatus including a polishing head and one or more fluid sources, for coupling fluids between rotatable and nonrotatable portions thereof. The polishing head has a nonrotatable portion and a rotatable portion including a rotatable shaft and an interior chamber enclosed within the polishing head. The device comprises means adapted to mount to the non-rotatable portion of the polishing head for confining and continually coupling a fluid between the non-rotatable fluid source and a region adjacent to an exterior surface of the rotatable shaft. The device also comprises means for confining and continually coupling a pressurized fluid between a region adjacent to the exterior surface of the rotatable shaft and the enclosed interior chamber.

In another embodiment, the two independent pressure chambers are provided so that two different pressure differentials may be defined to independently control a polishing pressure between one wafer surface and the polishing surface and to control the separation of the polished wafer face from the polishing surface.

Embodiments of the invention may also include means for delivering a positively pressurized fluid having a pressure higher than the surrounding ambient pressure to the attachment surface for separating and cleaning the attachment surface and related structures.

The invention also includes a method for separating a wafer face from the polishing surface. The method comprises the steps of defining an adhesive force between the attachment surface and one of the two wafer regions; defining an adhesive force between the attachment surface and the other of the wafer regions which is different than that defined between the attachment surface and the one region so as to cause a non-parallel relationship between the one wafer face and the polishing surface; and moving the attachment surface in a manner that causes the wafer to separate from the polishing surface so that release and separation of the one wafer face from the polishing surface is facilitated.

The method of the invention may also comprise the further step of imparting a mechanical lifting force on one side of the attachment surface where the stronger adhesive force has been defined so that the combination of the stronger adhesive force and the mechanical lifting force preferentially lifts that region of the wafer first.

The method may also comprise other optional steps that provide for releasing the wafer and cleaning the channels and holes of polishing residues so that wafers may be reliably adhered when a vacuum adhesive force is used. These optional steps comprise delivering at least one positively pressurized fluid having a pressure higher than the surrounding ambient pressure to the attachment surface.

Other features and advantages of the invention either will become apparent or will be described in connection with the following, more detailed description of preferred embodiments of the invention.

BRIEF DESCRIPTION OF THE DRAWINGS

With reference to the accompanying seven sheets of drawings.

DESCRIPTION OF THE PREFERRED EMBODIMENT(S)

The following relatively detailed description is provided to satisfy the patent statutes. However, it will be appreciated by those skilled in the art that various changes and modifications can be made without departing from the invention as defined by the claims and their equivalents.

Figure 1:
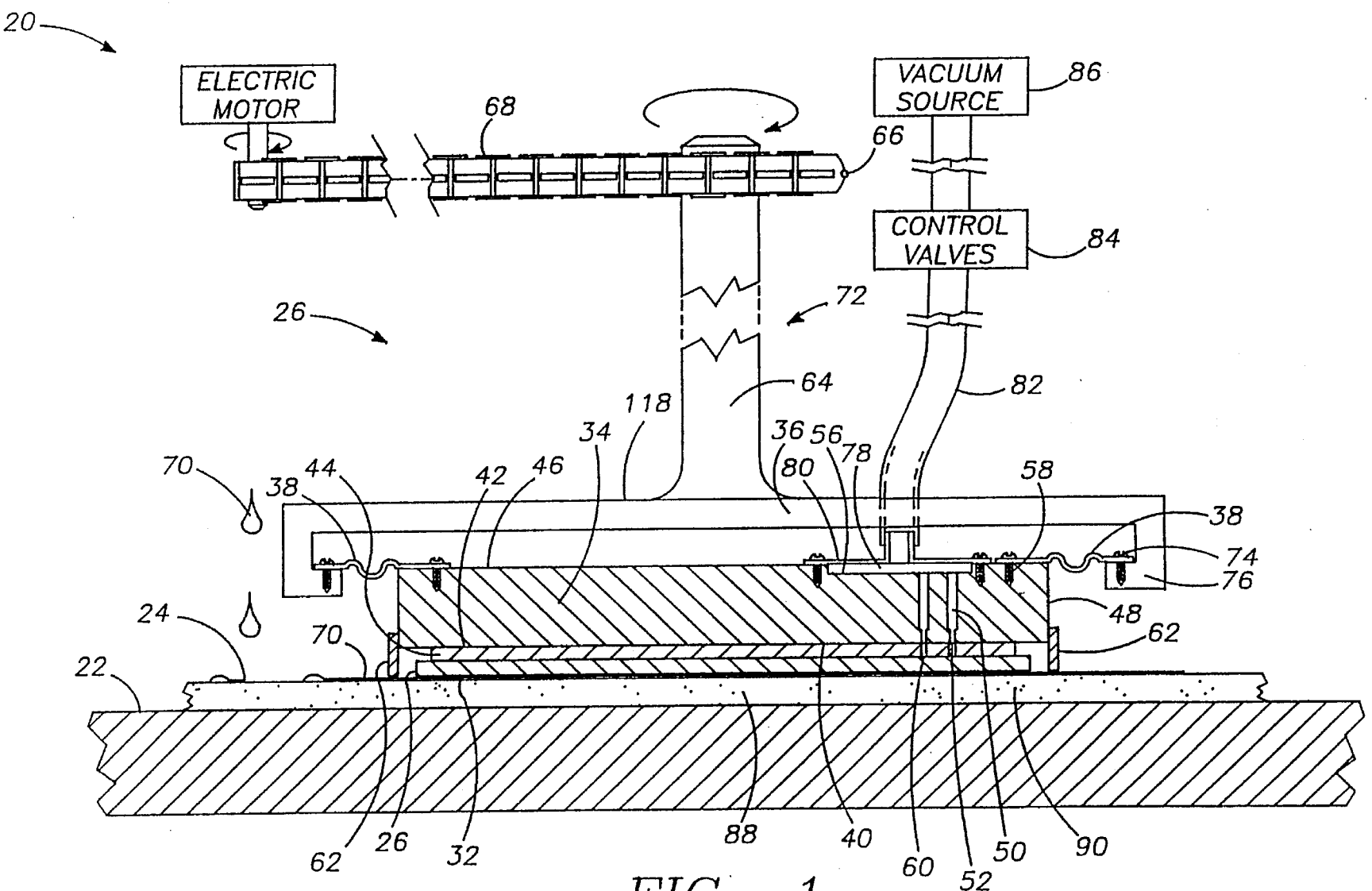
FIG. 1 is a partial sectional view of a simple embodiment of the polishing head according to the invention.

In FIG. 1, the invention is illustrated in conjunction with a polishing apparatus 20 having a polishing surface 22 to which is adhered polishing pad 24 for polishing one of a pair of opposed faces of a semiconductor wafer 26. Polishing pad 24 is adhered to a polishing surface 22 either directly in a conventional manner, or a cushioning pad (not shown) may be interposed between the surface 22 and pad 24. The pad opposes the wafer front face 32 to be polished during polishing. Wafer face 32 is generally planar and oriented during polishing parallel to and in substantial contact with the polishing pad on polishing surface 22. While a polishing pad is generally used, a separate polishing pad 24 may not be required where the polishing surface has suitable properties for polishing the wafer.

A device according to the invention comprises an attachment adapted to be mounted to polishing apparatus 20 so as to permit an attachment surface defined by the polishing apparatus to tilt relative to polishing surface 22. The attachment surface is configured to mate with two regions of wafer 26 so that the wafer adhered to the attachment surface also tilts relative to the polishing surface when the attachment surface tilts.

In the illustrated embodiment, the attachment is a carrier 34 for a wafer which is flexibly attached to main body 36 of the polishing head by flexible couplings 38. The flexible couplings permit attachment surface 40, defined by a surface of carrier 34, to tilt relative to polishing surface 22. Attachment surface 40 as illustrated is configured to mate with two regions of the back face 42 of the wafer. Back face 42 is shown in contact with optional insert 44 which is interposed between the wafer and the attachment surface. Optional insert 44 is preferably provided to cushion the wafer during polishing.

In the illustrated embodiment, the aforedescribed two regions of the wafer are different regions on the back face 42 of the wafer; however, other configurations defining the two wafer regions may be used. The back face of the wafer is adhered to the carrier during polishing. Carrier 34 also has an upper surface 46 and a circumferential side surface 48. Fluid transport channels 50 extend through the body of carrier 34 between upper surface 46 and attachment surface 40 and open on apertures or holes 52 within a limited region 54 of the attachment surface.

In the illustrated embodiment, carrier 34 is an attachment to the polishing head of the polishing apparatus; however, in other embodiments, a separate wafer carrier need not be provided and the attachment may comprise other structure having the requisite characteristics. Examples of alternate embodiments are described hereinafter.

FIG. 1 illustrates an embodiment of the invention with a carrier 34 having a generally round disk-like shape; however, other shapes may be used. The carrier is preferably formed from a nonporous ceramic material, but other materials including metals, polymeric composite materials, and the like may be used. Ceramic materials are generally preferred because they offer good thermal stability and which reduces the likelihood of thermally induced wafer distortions during polishing. Non-porous carrier materials are preferred because they do not absorb the polishing slurry and can be cleaned, whereas porous materials may be difficult or impossible to clean from a practical standpoint, and should be regularly replaced.

Figure 2:
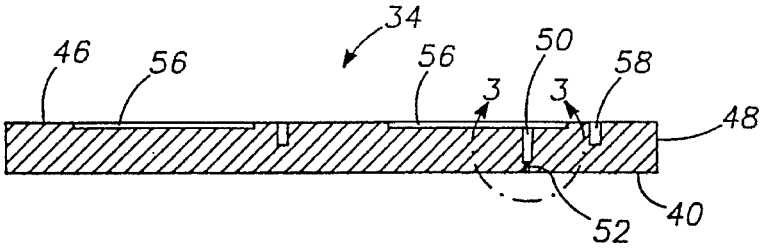
FIG. 2 is a sectional view of an embodiment of a wafer carrier incorporating the invention.
Figure 3:
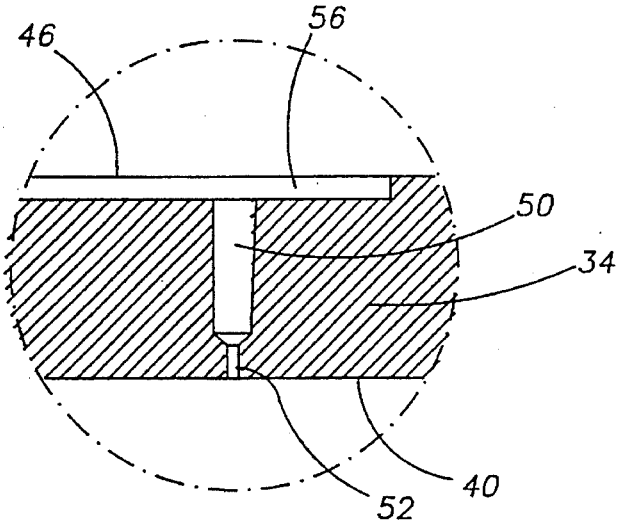
FIG. 3 is a sectional view of a portion of the wafer carrier in FIG. 2.
Figure 4:
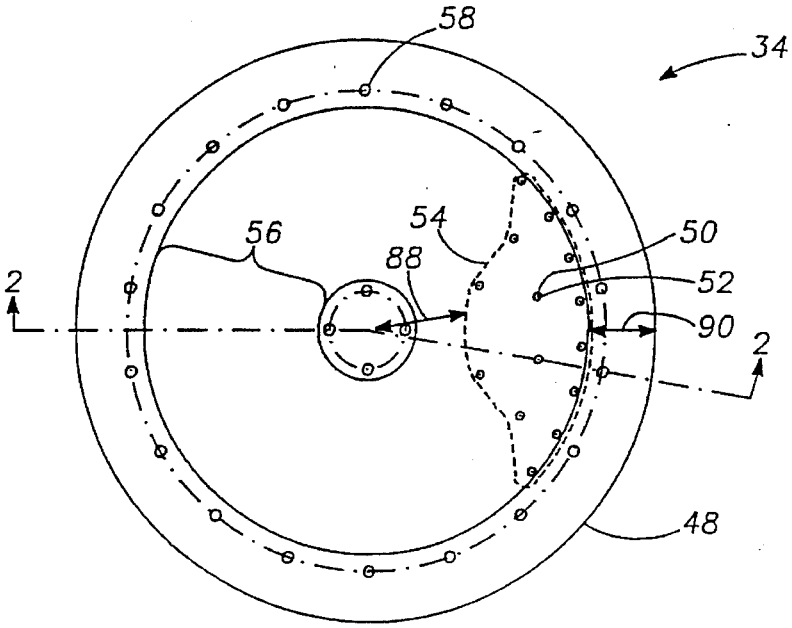
FIG. 4 is a top view of an embodiment of the wafer carrier in FIG. 2.

FIG. 2 shows a view of a carrier shown in FIG. 1 in isolation from the polishing apparatus. Only a single channel 50 and hole 52 is shown in the sectional view of FIG. 2 because of the location of the imaginary cutting plane A—A through the carrier, as shown in FIG. 4. FIG. 3 shows a small section of the carrier shown in FIG. 2, particularly illustrating the structure of an embodiment of fluid transport channels 50 and their relationship to holes 52 on attachment surface 40. This carrier provides the differential force by providing a differential adhesive force over the two regions.

Carrier 34 should be sized to accomodate the wafer to be polished on the attachment surface. For example, a different sized carrier 34 is preferrably used for polishing different sized wafers, such as carriers adapted for the attachment of the 5-inch and 8-inch diameter wafers typically used. It may also be desirable to design polishing head 20 to optimally polish wafers of a particular size, so that the polishing head design, including the carrier design, is adapted to produce optimum or near optimum polishing results for a particular wafer size.

The wafer carrier should be designed and fabricated so that it does not distort from the applied mechanical or thermal stresses that may be encountered during wafer polishing, or from the stresses that may be induced during the adhering or release of the wafer in accordance with the present invention. Therefore, the material chosen should be relatively insensitive to thermal expansion and the internal structure of the carrier should be simple and as uniform as possible even when the fluid transport channels are present, so that structural characteristics that might lead to distortion are minimized. Holes 52 should be relatively small, for example between about 10 mil (about 0.13 mm) and about 100 mil (about 1.3 mm) in diameter, and more typically between about 40 mil (about 0.5 mm) and about 50 mil (about 1.3 mm) in diameter. (Note that 1 mil equals 0.001 inches.) Generally, channels 50 should have a cross section that is at least as large as the diameter of holes 52, but channels with larger cross sections are typically used to assure that polishing residues that may possibly cover the holes at the surface do not clog the channels. Channels may be of any shape which permits the communication of pressurized fluids to the holes and maintains the structural rigidity of the carrier. Larger or smaller holes and channels may be used for some applications. If the holes are made too large then the polished wafer may contain unacceptable surface variation related to the presence of the holes.

FIG. 4 shows a top view of the carrier in FIG. 2. In this embodiment of the carrier, the plurality of holes 52 are confined to limited region 54 which is located within a sector of an annular region extending from about one-third of the radius of the attachment surface to about two-thirds of the radius of the attachment surface. In the illustrated embodiment, the limited region is contained within about a 90 degree angular sector (one quadrant) of wafer carrier 34. Locating the holes within the limited region facilitates providing the differential adhesive force between the two regions, where the limited region is one of the regions and the area outside of the limited region is the other region.

This exemplary embodiment has fourteen holes 52; however, more or fewer holes may be provided so long as they are sized and distributed to provide a suitable differential adhesion force (as described hereinafter), and do not result in carrier or wafer distortion. Recess 56 and mounting holes 58 for mounting carrier 34 to main body 36 via flexible coupling 38 are also illustrated. In an implementation of the exemplar of FIG. 4, holes 52 have a cross sectional area of about 0.0013 $in^2$ (about 0.8 $mm^2$) and channels 50 have a round cross section with a diameter of about 0.13 inches. Holes 52, the aligned holes 60 in optional insert 44, and channels 50 need not be circular in section; the holes, apertures, or channels may have other shapes.

A wafer retainer ring 62, optionally used, partially or completely surrounds the circumferential side surface 48 of carrier 34. Retainer ring 62 is provided to retain the wafer adjacent to the carrier by counteracting the side forces which develop on the wafer during polishing. Additional rotational action may be introduced by a rotating carousel to which the polishing heads are attached in some polishing systems.

Insert 44 comprises a layer of cushioning material that is interposed between the attachment surface and back face of the wafer. Use of the optional insert is preferred because it cushions the wafer during polishing. The insert is desirably formed of a resilient compressible cushioning material. Holes 60 are provided through the insert which are aligned with holes 52 on the attachment surface of the carrier.

Spindle shaft 64 couples main body 36 of the polishing head to an electric motor via drive sprocket 66 and drive chain 68; however, various other means for rotating the spindle shaft are known in the mechanical arts and may be used. Rotation of spindle shaft 64 results in rotation of the carrier to which the wafer is adhered during polishing.

A wet polishing slurry 70, generally comprising a polishing abrasive suspended in a polishing liquid such as water, is applied as a wet fluid to polishing pad 24 and remains as a wet layer during and after polishing. Various types of polishing slurry are known and may be used. The slurry is interposed between the front face 32 of the wafer and the polishing pad during polishing so that the wafer is substantially in contact with the pad, only the thin layer of polishing slurry preventing actual contact under polishing conditions.

The wet and in some cases viscous nature of the polishing slurry and the characteristics of many polishing pads, including physical structure and/or pad material composition, contributes to a strong adhesion between the wet polishing pad and the polished front surface of the wafer in the form of a vacuum-type suction force. The strong adhesive suction makes it difficult to remove the wafer from the pad when an attempt is made to lift the wafer from the pad after polishing has been completed. The strong adhesion results from of a combination of several factors including the presence of small pores on the surface of polishing pad 24 of many types of polishing pads which act as miniature suction devices; the highly polished front surface of the wafer which can be held by the small pores in the pad which act like miniature suction cups; the presence of wet liquid polishing slurry between the wafer and the pad which tends to seal and enhance the suction holding action of the pores; and the fact that a polishing pressure has been applied between the wafer and the pad during polishing.

Flexible couplings 38 provide means for mounting the carrier to the polishing apparatus to permit the attachment surface defined by the carrier to tilt relative to the polishing surface. The flexible coupling provides a nonrigid coupling between main body 36 of polishing head 72 and wafer carrier 34. This flexibility allows the carrier to float, tilt, or pivot between different positions and angular orientations independent of the orientation of main body 36.

In the partial sectional view of FIG. 1, flexible couplings 38 are two separate rectangular strip-like elements; however, it will be understood that when the carrier is disk-like, the flexible coupling may have the shape of a full or annular disk that is continuous between the two regions shown in FIG. 1. The couplings may also be either flat or alternatively they may be formed in a manner that provides the desired flexibility and range of movement for an optional floating carrier design (described in greater detail hereinafter) such as by pleating, by forming a smoothly undulating wave-like surface, and the like. The flexible coupling may be made from a variety of suitable materials such as polymeric materials, rubber, flexible spring-like metals, and the like. However, in some embodiments (described hereinafter) the type of material used to form the flexible coupling may be restricted to a material which is compatible with liquids and can provide a pressure seal.

In the illustrated embodiment, flexible coupling 38 is attached at one end to upper surface 46 of carrier 34, and extends to inner shelf 74 of main body 36 at other end. The flexible coupling may be attached to the carrier and main body by screws 76; however, other means for fastening, such as rivets, adhesives, pins, and the like may be used.

The particular coupling attachment geometry and type of non-rigid material are not important since the required deviation is relatively small. Structures and material types permitting a tilt corresponding to a displacement of between about five-thousandths of an inch (0.005 inches) and fifty-thousandths of an inch (0.05 inches) across a typical 8-inch wafer are sufficient. This range of displacement corresponds to an angular deviation of between about 0.035 degrees and about 0.35 degrees. Deviations between about ten-thousands of an inch (0.01 inches) to about twenty-thousandths of an inch (0.02 inches) over a 8-inch wafer may typically satisfy the requirement.

It will be understood that various ways of making a flexible coupling between the carrier and the main body are in accordance with the present invention, and the invention is not limited to the particular structure shown. It will also be understood that while the use of a separate wafer carrier coupled to the polishing head by flexible couplings permits the attachment surface to tilt or change angular orientation relative to the polishing surface, alternative means for permitting this tilt may be provided as described hereinafter and by their equivalents.

A device according to the invention also comprises means for defining an adhesive force between the attachment surface and one of the wafer regions, and means for defining an adhesive force between the attachment surface and the other of the regions which is a different region than that defined by the one region so as to cause a non-parallel relationship between the one wafer face and the polishing surface.

The combination of an attachment defining an attachment surface and permitting tilt of that surface, and first and second means for defining different adhesive forces between regions of the wafer and the attachment surface, facilitates separation of the polished wafer face from the polishing surface when desired, and at a lower total force than may generally be achieved using conventional apparatus and methods.

Chamber 78 is defined by a recess 56 adjacent upper surface 46 of the carrier in combination with cover 80. A pressure may be defined within chamber 78 and its magnitude and sense (positive or negative) may be varied to be lower than the ambient pressure external to the chamber (a negative or vacuum pressure), the same as ambient pressure external to the chamber, or higher than the ambient pressure external to the chamber (a positive pressure). Chamber 78 is connected via tubing 82 to control valve 84 and hence to vacuum source 86. Control valve 84 controls whether the vacuum force from source 86 is applied to or removed from chamber 78. The control valve may also control the flow of other pressurized fluids into the chamber as will be discussed hereinafter in the context of other embodiments of the invention.

In general, a volume of fluid may be present at a lower pressure than the pressure extended by a different reference volume of fluid, in which case the volume of fluid is at a lower or negative pressure with respect to the reference volume. Analogously, a volume of fluid may be present at a higher pressure than the pressure extended by different reference volume of fluid, in which case the volume is at a higher or positive pressure with respect to the reference volume. In either case the fluid in the reference volume may be the same or a different type of fluid. As used in this application, the reference volume against which the pressure in chamber 78 is compared is generally the air surrounding the polishing device.

A negatively pressurized fluid is a fluid, such as a gas or liquid but particularly a gas, which exists at a lower pressure than some reference pressure (such as the ambient atmospheric air pressure surrounding the device). A vacuum is an example of a negatively pressurized fluid and is a volume of space from which molecules, such as molecules of air, have been evacuated. Evacuation of a region of space creates a region of reduced or negative pressure relative to the surrounding or other reference volume of space. The region of reduced pressure can exist for a period of time even if the volume of space evacuated is not enclosed by a barrier impermeable to the evacuated fluid; however, gas molecules will move from the volume of higher pressure to the volume of lower pressure to equalize the pressure.

A positively pressurized fluid is a fluid, including either or both of a gas and a liquid, which exists at a greater pressure than some reference pressure (such as the ambient atmospheric air pressure surrounding the device). A positive pressure is generally the result of confinement of a compressible fluid within a fixed volume with the application of a compressive force so that molecules of the fluid are compacted together. A noncompressible liquid may also be pressurized by the introduction of a compressible gas within the same sealed vessel. In such a situation, the noncompressible fluid is pressurized and will be ejected at high velocity if the enclosing vessel is opened to a lower external pressure, such as the surrounding atmospheric pressure.

Chamber 78 defines a volume of space in which a fluid (gas and/or liquid) may be introduced and partially or completely sealed so as to create a pressure differential with respect to a volume of space external to the chamber. The pressure developed within the chamber may be positive or negative with respect to the surrounding ambient atmospheric air pressure.

When a wafer is to be adhered to the carrier, a vacuum pressure is developed within chamber 78 and this vacuum or negative pressure is communicated through the body of carrier 34 via a plurality of fluid transport channels 50 which open as holes 52 within a limited region 54 on the attachment surface 40.

In the illustrated embodiment, limited region 54 is located between a central region 88 and peripheral region 90 of the attachment surface. Holes 52 should not be provided too near to the peripheral region because if the vacuum force is applied too close to the edge of the wafer, the wafer may break when it is lifted away from the polishing pad. However, application of the adhesive vacuum force toward central region 88 is relatively less effective than application further from the center. Therefore, the distribution of the adhesive force should be chosen with these compromises in mind. Other distributions of holes between the central region and the peripheral region may be provided. To achieve the desired adhesive force differential, the limited region will generally cover less than about one-half of the surface, and more usually less than about one-third of the surface.

When a wafer is brought sufficiently close to, or in contact with this region of the attachment surface, the vacuum results in evacuation of atmospheric air from between the back face of the wafer and the attachment surface. The wafer is drawn toward the attachment surface because the reduced pressure on the evacuated back face compared to the greater atmospheric air pressure present and pushing on the front face. This vacuum pressure results in a net force which initially moves the wafer toward the attachment surface and then adheres it there.

When optional insert 44 is interposed between the attachment surface and the wafer, insert holes 60 which align with holes 52 on the attachment surface allow the vacuum (and other pressurized fluids) communicated to holes 52 to be further communicated to the back face of the wafer.

Different adhesive forces are defined over different regions of the attachment surface because of the localization of holes 52 within limited region 54 causes somewhat different pressure levels on the surface. The different pressure levels may be termed a differential pressure, and create an unbalanced adhesive force over the attachment surface. The corresponding mating regions of the wafer are therefore exposed to different adhesive forces when brought close to or in contact with the attachment surface (including the optional insert). The vacuum pressure in a volume of space proximate the limited region 54 is a higher magnitude pressure than the pressure in the volume of space proximate the attachment surface outside limited region 54 where there are no holes 52. The adhesive force is stronger where the vacuum is stronger within limited region 54.

Removal of the wafer from the polishing surface is facilitated by causing a non-parallel relationship (e.g. a tilt) between the polished wafer face and the polishing pad adhered to the polishing surface at the completion of the polishing operation. The differential adhesive forces may be applied to cause a passive tilt of the wafer or separate means may be provided to actively tilt the wafer. In order for the differential adhesive forces to passively cause the desired non-parallel relationship, the stronger of the two adhesive forces should be applied to a region of the wafer that can move away from (e.g. tilt upward) the polishing surface so that the wafer face may be separated from the polishing surface. When an active tilting means for lifting the carrier is provided as described hereinafter, the lifting should first occur proximate the region where the adhesive force is strongest, i.e., it should be aligned with limited region 54.

In the illustrated embodiment, flexible couplings 38 permit the carrier to tilt equally in any direction. Appropriate tilt to separate the wafer from the polishing surface (e.g. upward tilt) will naturally occur when the carrier is coupled in the manner in the region of greater adhesive force when differential adhesive force is applied.

By bringing the back face of the wafer to a location adjacent to the attachment surface, the wafer is urged toward and adhered to the limited region of the attachment surface by the greater magnitude adhesive force (e.g. vacuum pressure) and as a result, the attachment surface tilts to cause a non-parallel relationship between a portion of the front face and the polishing surface.

While the invention has been described with respect to specific structures it will be appreciated that other means for defining an adhesive force between the attachment surface 40 and one of the wafer regions, and that other means for defining an adhesive force between attachment surface 40 and the other of the wafer regions which is different than that defined by the one region so as to cause a non-parallel relationship between said one wafer face and said polishing surface, may be provided.

In the embodiment illustrated in FIG. 1, both of the regions of the wafer subjected to the differential adhesive forces are on the back face of the pair of opposed faces of the wafer, so that the differential adhesive force on two regions of another face results in facilitating separation of the other one of the faces to be polished from the polishing surface. However, it will be understood that the regions may be other than as illustrated. Furthermore, the means for defining an adhesive force between the attachment surface and the other region includes a vacuum source, and channels and holes provide directing means to direct the vacuum provided by the source to the other of the regions. However, it will be understood that other means for defining an adhesive force and means to direct the adhesive force may be used.

In the embodiment illustrated in FIG. 1, both of the wafer regions at which adhesive forces are defined are on the face of the wafer opposed to the one polished face, a vacuum source is provided for evacuating fluid (e.g. air) from between the attachment surface and both of the two regions of the wafer, and the directing means includes means for selectively directing vacuum (including channels and holes) which otherwise might be applied to both of the regions, to only one other region to the exclusion of the other. However, it will be understood that other means for evacuating fluid and other means to direct the adhesive force may be provided.

Generally, wafer 26 is a planar structure with opposing parallel sides, and the attachment surface tilts from a parallel orientation to a non-parallel orientation relative to the polishing surface. However, the back face of the wafer may be nonplanar. The invention may be used with any suitable polishing apparatus for polishing a planar surface so long as an appropriate attachment surface is provided. For example, a wafer having a spherical, conical, or other curved or piecewise-planar back face profile may be attached to a suitably conforming attachment surface. In such a case, the attachment surface may not be parallel to the polishing surface, yet it is adapted to be mounted to the polishing apparatus in a manner that permits tilt to an orientation that results in a non-parallel relationship between a region of the planar wafer face and the polishing surface. The attachment face may also be offset from the center of the wafer.

The operation of an embodiment of the invention is now described with respect to the apparatus illustrated in FIG. 1. At the start of the polishing operation the wafer is placed sufficiently close to, or in contact with insert 44 on the attachment surface 40 so that the adhesive vacuum force communicated from vacuum source 86 to holes 52 opening within the limited region of the attachment surface adheres the wafer to the attachment surface. Then, the entire polishing head assembly 72 is moved relative to polishing pad 24 to bring the front face of the wafer into contact with the polishing pad to which the wet polishing slurry has been applied. Vacuum force is removed from chamber 78 and therefore from the attachment surface so that the pressure is substantially the same as ambient pressure, so as not to distort the wafer during polishing. Once the vacuum is removed, the wafer may remain in contact with the attachment surface but is not adhered to the surface. Retainer 62 maintains the position of the wafer relative to the attachment face during polishing. The front face of the wafer is then polished to achieve the desired surface characteristics.

Upon completion of polishing, vacuum force is reapplied to the limited region of the attachment surface to create a differential adhesive force with respect to the region of the attachment surface outside the limited region so that the wafer is adhered to the attachment surface of the carrier. The force required to re-adhere the wafer to the attachment surface is substantially greater at the completion of polishing than prior to polishing.

Prior to polishing, the vacuum force supplied by vacuum source 86 need only be sufficient to hold the weight of the wafer against the force of gravity. However, at the completion of the polishing operation, one face of the wafer is in intimate contact with the polishing pad and other surface is in contact with the attachment surface of the carrier (or with the insert mounted to the attachment surface). Before polishing, the back face is not highly polished, liquid is not deliberately provided between the wafer and the insert (although some seepage can occur), and the surface properties of the insert are generally different from the properties of the polishing pad, i.e. pores of the type on the pad are not present on the insert. As a result, the wafer may be more strongly adhered to the polishing pad after polishing than to the insert, even though the wafer remains in contact with both surfaces.

The reduction in required separation force provided by the present invention is significant because the ambient atmospheric pressure (usually less than about 15 $lbf/in^2$) may impose a limit on the maximum vacuum force which can be applied to attachment surface 40 to overcome the counter-adhesive force between the polishing pad and the wafer to release the wafer. The force may also be limited by the total area over which the vacuum may be applied (an 8-inch diameter wafer is typical). It will also be understood that the number and extent of fluid transport channels 50 which open onto holes 52 at the surface must be limited by the need to have a stable distortionless wafer carrier structure. Any significant carrier distortion may result in an unacceptable wafer surface after polishing. Removal of the distorting force after polishing can not eliminate the distortion because of the intervening removal of wafer surface material. Therefore, the holes should occupy a relatively small portion of the attachment surface.

Vacuum force is applied over limited region 54 of the carrier attachment surface to more strongly adhere the region of the wafer adjacent to the limited region than to other regions. Such unbalanced vacuum force is more effective than the application of a uniform vacuum force over the entire surface of wafer carrier attachment surface when attempting to lift and remove the wafer from the polishing pad surface.

Concurrently with the application of the unbalanced vacuum adhesive force, the carrier is permitted to tilt slightly as the wafer is lifted from the polishing pad so that the wafer which is attached to the attachment surface is also tilted. Passive or active means for tilting the attachment face or for allowing the attachment face to tilt may be provided, although active tilt of the carrier is preferred because it provides more reliable release of the wafer. Application of an unbalanced vacuum alone, that is application of a vacuum over a limited region 54 of the mounting surface 40 by itself without passively permitting or alternatively actively causing tilt may not be more effective than a uniform or balanced vacuum force applied over the entire attachment surface. The tilting and the resulting lifting or flexing of a portion of the wafer does not occur if the attachment surface mounted in a completely rigid or fixed orientation with respect to the polishing surface, or equivalently with mounted in a rigid position with respect to spindle shaft 64.

The embodiment illustrated in FIG. 1 provides a passive means for tilting because the application of the unbalanced vacuum adhesive force to a non-rigidly coupled carrier results in tilt. A separate independent tilting force is not used or required in this embodiment. Flexible couplings 38 cooperates with application of the vacuum adhesive force to limited region 54 to provide the tilt.

The cooperative tilt and easy release are believed to occur as the result of several contributing mechanisms. After the completion of polishing when main body 36 is initially lifted upward from the surface of the pad, the carrier attachment surface also begins to raise but is somewhat delayed due to the adhesive force between the pad and the wafer. The application of vacuum to the holes within the limited region adheres the wafer more strongly within the limited region than it adheres the wafer in the region of the wafer outside the limited region. The portion of the wafer adjacent the holes is believed to be lifted preferentially, that is sooner and/or more strongly than the region of the wafer more distant from the holes.

Lifting of the more distant region of the wafer is believed to be delayed for a short time (fractions of a second) and the wafer proximate that region remains in contact with the pad. The tilt of the carrier and the wafer are believed to be achieved by the stronger lifting of the region of the wafer proximate the limited region which causes a slight flexing of the wafer. The flexure allows that portion of the wafer proximate the limited region to break free of the counter-adhesive suction force adhering the wafer to the polishing pad without requiring the entire suction force to be overcome simultaneously. Once the portion of the wafer adjacent the limited region of the attachment surface wafer lifts free, the counter-adhesive suction force is broken with the remainder of pad 28. When the wafer is lifted free from the polishing pad, it is retained on attachment surface 40 by the force of vacuum applied via channels 50 through holes 52. Retention of the wafer on the attachment surface after the wafer is released from the pad requires an adhesive force; however, the unbalanced or differential force is not needed to return the wafer.

In the embodiment illustrated in FIG. 1, both of the regions to which different adhesive forces are applied are on the back face of the pair of opposed faces of the wafer. In this manner, the differential adhesive force on two regions of another face (e.g. the back face) facilitates separation of the other one of the faces to be polished (e.g. the front face) from the polishing surface. However, it will be understood that invention is not limited to different adhesive forces applied to regions on the same face.

The embodiment illustrated in FIG. 1, discloses a device wherein both of the wafer regions to which the adhesive forces are applied are on the face of the wafer opposed to the one face to be polished, a vacuum source is provided for evacuating fluid from between the attachment surface and both of the regions of the wafer, and the directing means includes means for selectively directing vacuum which otherwise might be applied to both of the regions to the other wafer region to the exclusion of the other. However, other configurations of regions to which differential adhesive forces may be applied may be provided and other means for selectively directing the adhesive force may be used.

For example, the differential adhesive force may be provided by a suitable surface treatment of an attachment surface which provides a stronger bond between one region of the attachment surface and the wafer than between a different region of the attachment face and the wafer. The surface treatment may cooperate with a uniform or nonuniform vacuum force or be used in conjunction with a different type of adhesive force. For example, one region of the attachment surface could be polished while another region of the attachment surface has a somewhat textured surface characteristic. Such a polished surface would provide more intimate contact between the attachment surface and the wafer when the vacuum is applied and the more intimate contact will result in a greater adhesive force. Alternatively, embodiments may provide for a localized adhesive insert that is recessed into the body of a carrier to provide a uniformly planar attachment surface yet has different adhesive properties between different regions.

While a carrier coupled to the main body of the polishing head has been specifically described, other alternative means for permitting tilt may be provided. For example, a polishing head that is specifically formed to provide tilt may be used, or a polishing head that has a sufficiently loose dimensional tolerance to allow angular deviation (tilt) from its normal parallel orientation with respect to the polishing surface may be used. However, the tolerances should not be so loose that the accuracy and precision of the polishing operation is compromised.

Various suitable alternate means for permitting tilt may be provided. For example, the wafer may be adhered directly to an attachment surface 40 on the rigid polishing head 72 and providing mechanical tolerances between mating portions of bearing surfaces which couple the spindle shaft 64 portion of the polishing head to other portions of the polishing apparatus. The loose mechanical tolerances permit the attachment surface to tilt or change angular orientation relative to the polishing surface. Alternately, an articulated joint, or a ball and socket type joint, may be provided between a spindle shaft 64 and a rigid main body 36 thereby permitting the attachment surface to tilt or change angular orientation relative to the polishing surface. Alternately, a resilient compressible insert 44 interposed between the surface 40 of the carrier defined by an otherwise rigid polishing head and the wafer will permit the surface to which the wafer is adhered to tilt or change angular orientation relative to the polishing surface. In this embodiment the attachment surface is the surface of the insert rather than the surface of the carrier itself. Other suitable means for permitting tilt as are known in the mechanical arts may also be used.

While the invention overcomes the problems associated with a wet polishing surface, the invention may be used to release a wafer adhered to the polishing pad in other situations, such as the situations where a dry or alternatively a thick paste-like polishing or lapping compound is used and result in analogous wafer release problems.

Figure 5:
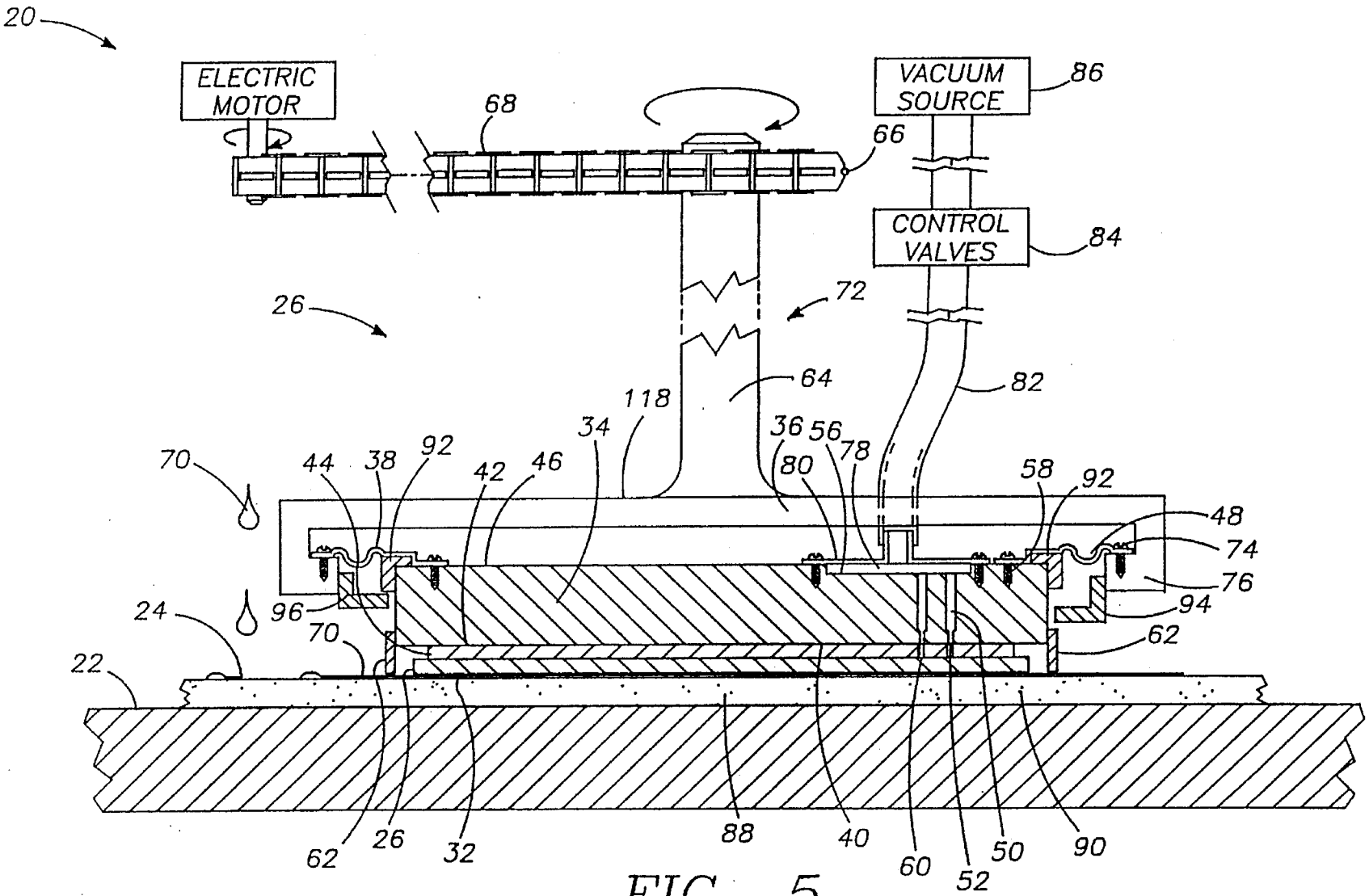
FIG. 5 is a partial sectional view of a second embodiment of the polishing head according to the invention.

FIG. 5 shows a second embodiment of the present invention which is somewhat more sophisticated than the embodiment illustrated in FIG. 1. While the embodiment in FIG. 1 provides an attachment that permits an attachment surface to tilt, the embodiment in FIG. 5 provides means for actively tilting the attachment surface. Providing means for actively tilting the attachment surface is included within the broader concept of providing an attachment adapted to be mounted to the polishing apparatus so as to permit an attachment surface to tilt relative to the polishing surface. Like numbered elements in FIG. 1 and FIG. 5 have correspondingly similar structure and function.

In this embodiment, lifting shelf 92 is fixedly attached to wafer carrier 34 and three corresponding lifting prongs 94, 96, 98 (not shown) are attached to a portion of main body 36 to provide means for actively tilting the attachment surface 40 concurrently with the application of a differential vacuum adhesive force. Three lifting points are used because they define a stable plane which is in a non-parallel relationship (e.g. tilted) with respect to the polishing surface. At least two of the lifting prongs are positioned at different relative heights from the pad. The three prongs are spaced 120 degrees apart in the illustrated embodiment, but other angular separations may be used. Although three lifting points are illustrated, additional lifting points may be used; and two lifting point structures may be sufficient if either one of them is large enough so that they define a stable plane or some instability can be tolerated during the lifting process.

Lifting prong 94, is located proximate the portion of wafer carrier 34 having fluid transport channels 50 opening onto holes 52. In particular, lifting prong 94 is positioned along a line extending from the center of the attachment surface 40 and through the center of the array of holes 52 so that the holes 52 are arranged substantially symmetrically with respect to the lifting prong. This arrangement assures that the region of the wafer experiencing the greatest vacuum adhesive force is the first region to be lifted from the pad. Lifting prong 96 is located proximal to a different region of wafer carrier 34.

When the wafer is being polished the lifting prongs do not engage the lifting shelf and the carrier floats on the polishing pad. The lifting prongs are located at different distances from the polishing surface. Therefore, when main body 36 of the polishing head is lifted away from the polishing pad, lifting prong 94 engages the lifting shelf before the others. Lifting prongs 96 and 98, positioned at a different distance from the polishing pad, engage the shelf at a later time during the lifting process. This arrangement of lifting prongs and lifting shelves provides a means for lifting the region of the wafer adjacent to the stronger vacuum adhesive force first, so that the wafer is tilted as it is pulled away from the polishing pad. While the arrangement of lifting prongs and lifting shelves attached to the main body and carrier respectively provide means for actively tilting the attachment surface, it will be appreciated that other means for actively tilting the attachment surface may be used.

Figure 6:
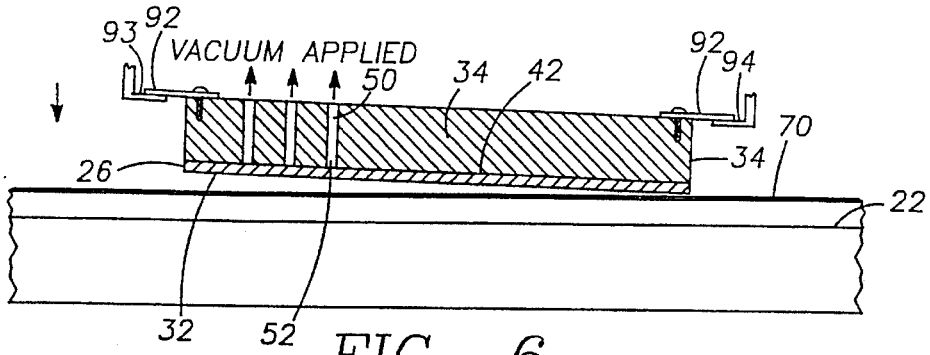
FIGS. 6–10 illustrate side sectional views of the wafer carrier and related structures as illustrated in FIG. 10, showing relative orientation of portions of the apparatus at various stages of operation.
Figure 7:
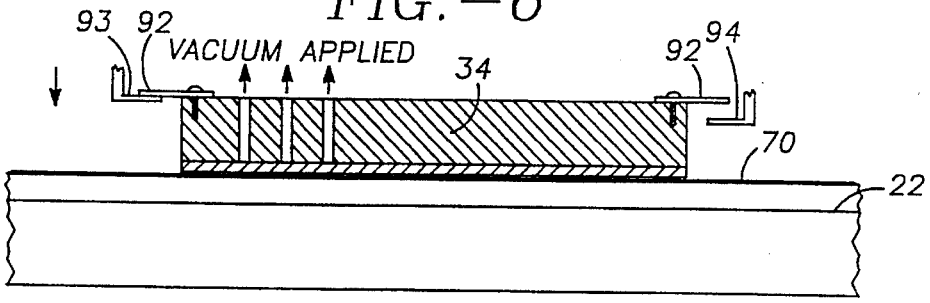

The operation of this active means for tilting is now described with reference to FIGS. 6–10. FIG. 10 is an illustration of a portion of the polishing head shown in FIG. 5, emphasizing the relationship between the lifting prongs 94, 96, 98 and lifting shelves 92. FIG. 6 shows the stage in the overall polishing process where a wafer 26 attached to the attachment surface 40 of carrier 34, is initially being lowered to contact polishing pad 28. Lifting prongs 94, 96, 98 contact their respective mating regions of lifting shelf 92 so that the carrier is supported by them as it is lowered toward the pad. Since the lifting prongs and lifting shelves are engaged simultaneously, the wafer is initially contacted with the polishing pad at other than parallel orientation.

Figure 8:
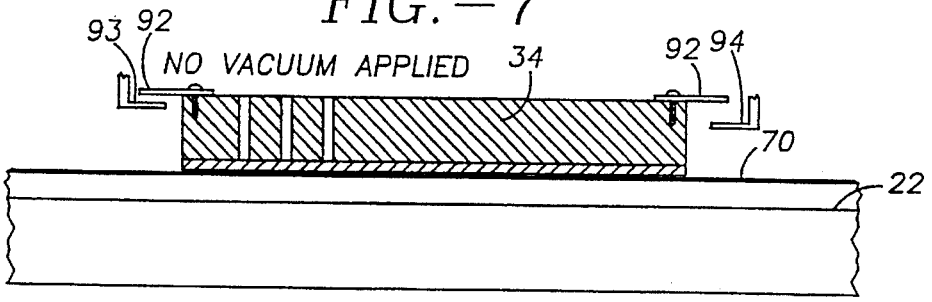

The deviation from parallelism during lowering (and during lifting) does not effect the actual polishing of the wafer since the wafer is in parallel engagement with the pad during polishing and the lifting prongs are disengaged from the lifting shelf as shown in FIG. 8. Preferably, the wafer is allowed to float on the pad after it has been lowered into contact. The embodiment of the invention illustrated in FIG. 10 retains flexible coupling 38 between main body 36 and carrier 34 so that the carrier is flexibly coupled to the polishing head and may float during the wafer polishing process.

FIG. 8 shows an intermediate stage wherein one lifting prong 94 is engaged with its respective lifting shelf 92, and the other lifting prongs are not engaged. FIG. 8 shows the orientation of the various portions of the apparatus during the actual polishing operation when none of the lifting prongs 94, 96, 98 are engaged with lifting shelf 92.

Figure 9:
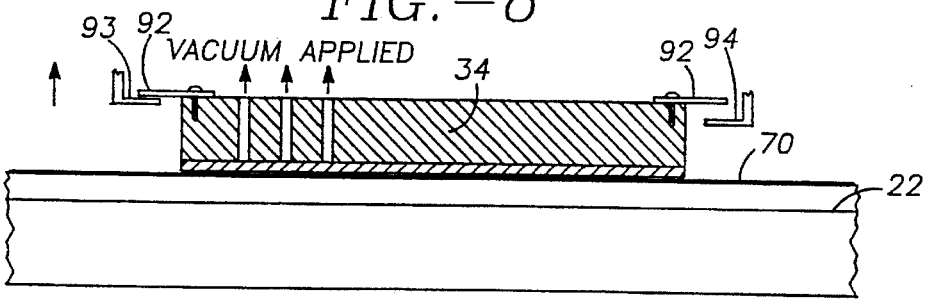
Figure 10:
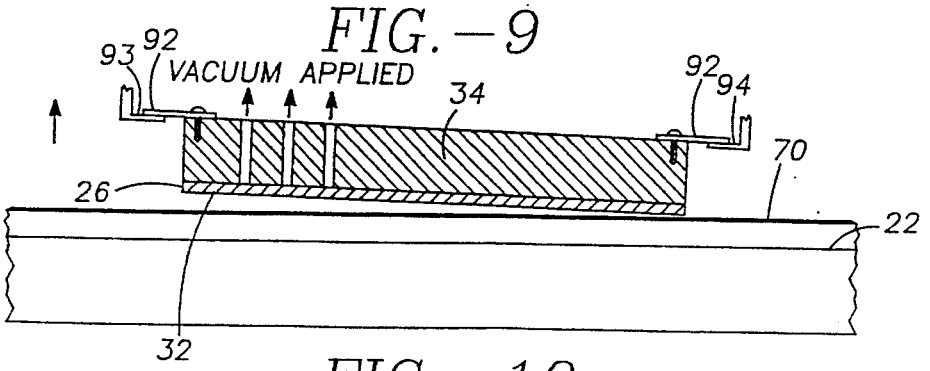

FIG. 9 shows a stage of the process at the completion of the polishing operation. At this stage, the main body 36 of polishing head 72 is being withdrawn upward from the polishing pad. Concurrently with this withdrawal, the differential vacuum adhesive force is applied via holes 52. This adheres the wafer to attachment surface 40.

As the main body of the polishing head continues to be withdrawn from the pad, lifting prong 94 initially engages lifting shelf 92 and begins to lift the carrier with the wafer adhered to the attachment surface, away from the polishing pad. The portion of the wafer and the carrier proximate lifting prong 96 may not be released at the same time as the other region. The differential lifting of the two regions results in the carrier and wafer being tilted away from the polishing pad, thereby breaking the adhesive force between the wafer and the pad so that the vacuum force is sufficient to retain the wafer on the attachment surface as it is lifted from the polishing pad.

FIG. 10 shows a further stage in the process wherein all of the lifting prongs 94, 96, 98 have engaged lifting shelf 92, and the carrier with attached wafer has been lifted and released from the pad.

Figure 11:
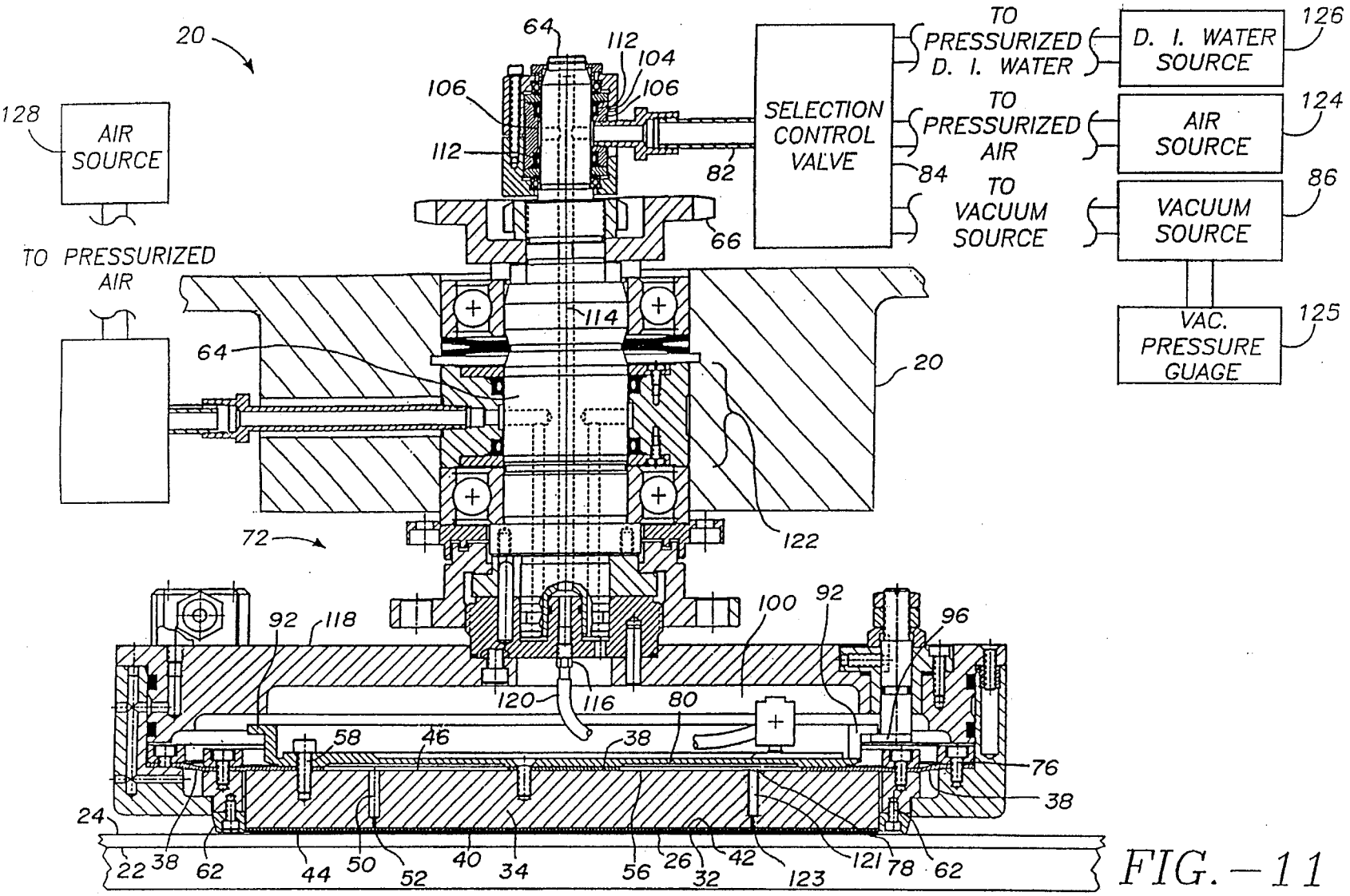
FIG. 11 is a partial sectional view of a preferred embodiment of the polishing head according to the invention.

FIG. 11 illustrates an embodiment of the invention which adds further refinements, and shows additional implementation detail compared to the embodiment illustrated in FIG. 5. This embodiment incorporates floating carrier and floating wafer retainer ring features of a polishing head originally disclosed in U.S. Pat. No. 5,205,082; the contents of which are hereby incorporated by reference in their entirety.

The present invention provides a polishing head having significant advantages and improvements in features and performance over that disclosed in U.S. Pat. No. 5,205,082. Several aspects of the apparatus and method of operation of the embodiment illustrated in FIG. 11 have been described either in reference to the embodiment in FIG. 5, or in U.S. Pat. No. 5,205,082; therefore only differences and additional features pertaining the present invention are described here.

Elements with like numerical references in FIG. 11 and FIG. 5 have correspondingly similar structure and function. Although differences in particular characteristics of the like-numbered elements can be seen between the simpler embodiment of FIG. 5 and the more detailed embodiment illustrated in FIG. 11, those having ordinary skill in the art will recognize the correspondence.

In FIG. 11, the invention is illustrated in conjunction with a polishing apparatus having a polishing head 72 which includes a floating carrier 34 and a floating retainer ring 62. Pressurized fluid is introduced into chamber 100 to when it is desired to provide a downward polishing force to press the wafer against the polishing pad during the polishing operation. Carrier 34 is flexibly coupled to the polishing head by flexible coupling 38. In this embodiment flexible coupling 38 is a flexible disk-like membrane that is impermeable to the fluids introduced into the chamber. The flexible membrane provides a pressure seal, in addition to flexibly coupling the carrier to the polishing head, so that a polishing pressure may be applied during the polishing operation, yet allow the carrier to float relative to the polishing pad so that contact between the wafer and the pad is maintained during the polishing operation. The floating carrier features are described in detail in U.S. Pat. No. 5,205,082.

Chamber 100 provides means for forming a pressure differential and for distributing a pressurized fluid to control the magnitude of the polishing force applied. Retainer 62 is connected to the wafer carrier 34 in such a manner that it also floats on the polishing pad during the polishing process but projects beyond the carrier to form a wafer pocket 102. Wafer pocket 102 is desirable because it facilitates wafer loading.

One structure for forming the pressure differential and for distributing a pressurized fluid to control the magnitude of the polishing force is illustrated in FIG. 11. However, it will be understood that other means for forming a pressure differential between two volumes on opposite sides of the flexible membrane to cause the carrier to exert a polishing force against the polishing surface during polishing in proportion to the pressure differential may be used.

A second pressure chamber 78, is used in conjunction with vacuum source 86 to provide the vacuum adhesive force for releasing the wafer from the pad and retaining it on the carrier at the completion of the polishing operation. Chamber 78 provides means for forming a pressure differential between a volume adjacent to a region of the attachment surface and another volume and for directing an adhesive force caused by the pressure differential to the wafer in proportion to the pressure differential.

In this embodiment, lifting shelf 92 is a plate-like structure having an annular shelf surface at its perimeter and is fixedly mounted to upper surface 46 of carrier 34. This plate-like shelf 92 helps maintain structural rigidity of carrier 34 and also facilitates the application of polishing pressure between the wafer and the polishing pad as described in the aforementioned U.S. Pat. No. 5,205,082. Because of the particular sectional view taken in FIG. 11 neither upper lifting prong 94 nor lifting prong 98 are shown. Lifting prong 96, distant from holes 52, is a lower lifting prong which engages lifting shelf 92 later than the higher lifting prong 94. The operation of these lifting prongs is the same as previously described with respect to FIGS. 10–15.

Rotary union 104 provides means for coupling a vacuum and/or other positively or negatively pressurized fluid or fluids (such as gas, air, vacuum, water, liquids, and the like) between a fluid source, such as vacuum source 86, which is stationary and non-rotating and rotatable polishing head carrier 34. The rotary union is adapted to mount to the non-rotatable portion of the polishing head and provides means for confining and continually coupling a pressurized fluid between a non-rotatable fluid source and a region of space adjacent to an exterior surface of the rotatable shaft. While a rotary union is specifically illustrated in the embodiment of FIG. 11, it will be understood that rotary unions are applicable to the other embodiments, such as those illustrated in FIGS. 1 and 10.

A fluid source, such as vacuum source 86, is coupled to rotary union 104 via tubing 82 and control valve 84. Rotary union 104 has a recessed area on an interior surface portion which defines a reservoir 106 between the interior surface portion 108 of the rotary union 104 and the exterior surface 110 of spindle shaft 64. Seals 112 are provided between the rotatable shaft 64 and the nonrotatable portion of the rotary union to prevent leakage between the reservoir 106 and regions exterior to the reservoir. Conventional seals as are known in the mechanical arts may be used.

Shaft 64 has one or more passageways extending from the exterior shaft surface to a hollow bore 114 within the spindle shaft. From bore 114 the vacuum or other pressurized or non-pressurized fluid is communicated to a coupling 116 located proximate surface 118 of main body 36. The precise location or existence of a separate coupling 116 is an implementation detail and not important to the inventive concept. The vacuum or other fluid is then communicated via a separate isolated conduit or channel 120 that passes through the volume of first chamber 100 to enclosed second pressure chamber 78. These recited structures provide means for confining and continually coupling one or more pressurized fluids between the region adjacent to the exterior surface of the rotatable shaft and the enclosed chamber, but other means may be used.

The vacuum pressure developed within second chamber 78 is communicated through the body of carrier 34 via the plurality of fluid transport channels 50 which open as holes 52 within a limited region 54 on attachment surface 40 as described previously.

Figure 12:
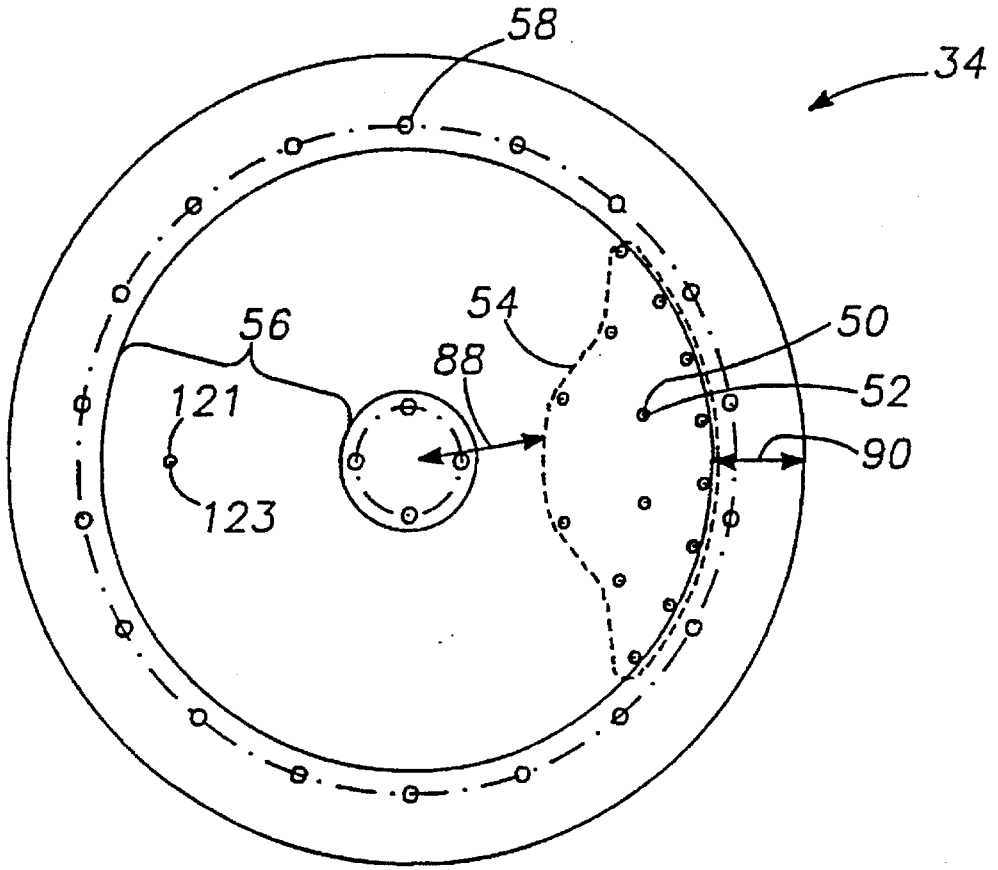
FIG. 12 is a sectional view of an embodiment of a wafer carrier having an optional vacuum sensor hole according to an embodiment the invention.
Figure 13:
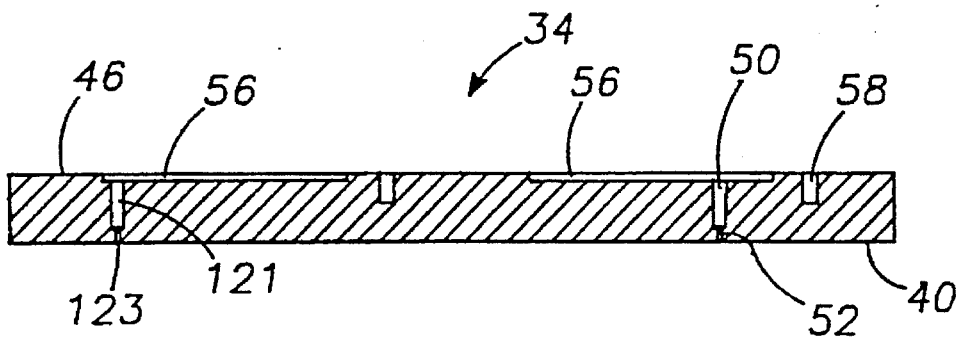
FIG. 13 is a top view of an embodiment of the wafer carrier in FIG. 12.
Figure 14:
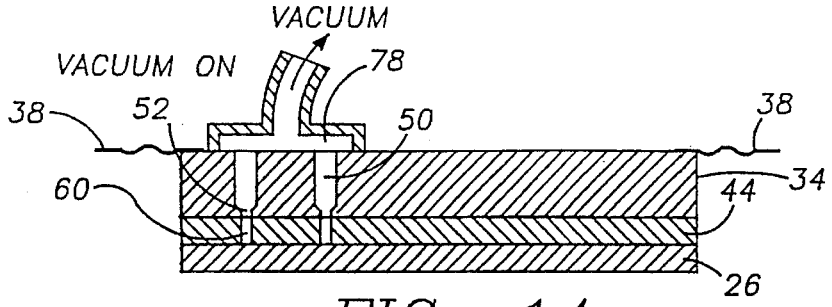
FIGS. 14–18 are sectional views, somewhat schematic, illustrating the release of a wafer from the attached surface of a carrier using positively pressured fluids according to an embodiment of the invention.

In this embodiment, an additional optional sensor channel 121 is provided which extends from chamber 78 through the body of carrier 34 and opens as sensor hole 123 on attachment surface 40. Sensor hole 123 may generally be the same size as one of holes 52. FIGS. 12 and 13 shows an exemplary embodiment of a carrier having optional sensor channel 121 and sensor hole 123. Sensor hole 123 is preferably located a maximum distance from holes 52 so that sensor hole 123 and one of the plurality of holes 52 substantially span the maximum dimension of the attachment surface. Sensor channel 121 and sensor hole 123 provide means for sensing the presence of a wafer over sensor hole 123. Holes 52 provide means for sensing the presence of a wafer over holes 52. Sensor hole 123 and holes 52 in combination provide means for determining whether a wafer is present and centered on the attachment surface. Maximum sensitivity for determining wafer centering is provided by having one of holes 52 and sensor hole 123 that span a diameter of the round carrier attachment face.

When a wafer is present and substantially centered on the attachment surface, then sensor hole 123 and each of holes 52 are covered by the wafer. When the holes 52, 123 are covered by the wafer then a larger magnitude vacuum pressure is developed within chamber 78 than when any of sensor hole 123 or holes 52 are uncovered. Holes 52, 123 may remain uncovered when a wafer is offset from the center of the attachment surface so that it does not overlay all of the holes or when a portion of the wafer is in contact with retainer 62 so that it is partially lifted from contact with the attachment surface.

The vacuum pressure within chamber 78 can be sensed by a vacuum gauge 125 coupled to the chamber, such as a vacuum gauge located within vacuum source 86. Gauge 125 will indicate a lower vacuum pressure than the vacuum pressure expected when all of sensor hole 123 and holes 52 are covered. A threshold pressure value may be established for automatically deciding when the wafer is centered and when it is not. Use of the optional sensor channel and sensor hole are useful in automated robotics applications when a wafer may be adhered but offset from the desired position when loaded on the carrier attachment surface. If the wafer is not properly loaded, corrective action may be taken. The sensor hole 123 is intended to more reliably load the wafer onto the carrier prior to polishing, but there is an effect on the differential vacuum adhesive force when the wafer is picked up from the polishing pad after polishing.

The development of a differential adhesive vacuum force between limited region 54 and the other region of the attachment surface (such as the region wherein sensor hole 123 is located) is achieved by limiting the size of single sensor hole 123 in relation to the size and quantity of holes 52. For example in one embodiment of the invention, a carrier having a single sensor hole 123 and fourteen holes 52 are provided. Each hole 52, 123 has the same size, about 0.04 inches in diameter is typically used. In general, the hole sizes need not be the same. The reduction in the differential adhesive force between the different regions may be in approximate proportion to ratio of the area of the holes within the limited region to the area of the sensor hole outside the limited region, in this example about a 7 percent reduction. Where maximum adhesive force is required to pick up the wafer from the polishing pad, means can be provided to isolate sensor hole 123 from the applied vacuum during post-polishing wafer pick up, such as by coupling channel 121 to chamber 78 with an intervening sensor channel control valve (not shown).

Two distinct pressure chambers 78, 100 are provided in this embodiment of the invention. Polishing pressure chamber 100 is isolated from wafer adhering and releasing pressure chamber 78 to allow independent operation of the two mechanisms. Similarly two rotary unions 104 and 122 are used, and separate fluid transport pathways are implemented from the fluid sources through the pressure head to the carrier region. Flexible coupling 38 is formed from a flexible non-rigid material compatible with the fluids that may be introduced into chambers 78 or 100, and provides a pressure seal between the two pressure chambers.

The embodiment illustrated in FIG. 11, also shows fluid delivery means for delivering at least one positively pressurized fluid having a pressure higher than the surrounding ambient pressure to the attachment surface. Positively pressurized gas source 124 such as a source of pressurized air, and a positively pressurized liquid source 126 such as source of pressurized water, are connected to control valve 84.

The control valve may comprise a single valve with multiple inputs or a plurality of separate valves, and may also include various electronic circuitry and/or other control system apparatus to coordinate the application or removal of vacuum, air, gas, water, or other fluid sources. In general, the control valve 84 permits a single fluid to be communicated to rotary union 104 at any particular time. However, a plurality of fluids may be contained within the polishing head at any given time, and may be applied in specifically timed sequences. The positively pressurized fluids permit controlled release of the wafer from the carrier and optional cleaning of the attachment surface as described hereinafter.

The operation of the embodiment of the invention illustrated in FIG. 11, particularly with respect to application of vacuum and positively pressurized air and water to adhere and release the wafer, is now described. A wafer is placed close to or in contact with attachment surface 40. Optional insert 44 may be interposed between the wafer and the attachment surface. An adhesive vacuum force from vacuum source 86 is communicated to the fluid transport channels which open as holes within the limited region of the attachment surface to adhere the wafer to the attachment surface. Wet polishing slurry is applied to the polishing pad and polishing head 72 is moved toward the polishing pad to place the front face of the wafer in opposing contact with the pad. Vacuum from vacuum source 86 is shut off during polishing so as not to distort the surface of the wafer. The wafer is polished by the combined rotational movements of the polishing head and the polishing pad. During polishing, the wafer is retained captive adjacent to carrier 34 by floating retainer ring 62. A source of positive pressurized air 128 is connected to chamber 100 via rotary union 122 to provide a controlled amount of polishing pressure between the wafer and the pad for optimal removal of material from the front surface of the wafer.

When the polishing process is completed, positively pressurized air 128 from second rotary union 122 is turned off to remove the polishing force. Then vacuum from vacuum source 86 is reapplied via first rotary union 104 to the attachment surface so that the back surface of the wafer is adhered to the attachment surface. The arrangement of the holes on the attachment surface provides an unbalanced vacuum adhesive force which is different in different regions of the surface. As the polishing head is lifted away from the polishing pad, the carrier is tilted by movement of the lifting prongs and lifting shelves as previously described, concurrently with the application of the unbalanced vacuum force. The suction force between the wafer and the pad is broken, and the wafer remains adhered to attachment surface 40 as the polishing head continues to separate.

The polishing head is typically withdrawn from the surface of the polishing pad at a speed of between about 0.1 in/sec (2.5 mm/sec) and about 1 in/sec (25.4 mm/sec). However, the speed is not critical and other withdrawal rates may be used so long as polishing head 72 is withdrawn away from the pad in a generally continuous manner until the polishing head (with attached wafer) is sufficiently separated from the pad so that the wafer can be released from the carrier.

FIGS. 14–18 illustrate successive stages in the release of the wafer from the attachment surface after the wafer has been released and lifted from the polishing pad. These FIGs. show a simplified, somewhat schematic, view of carrier 34 and its relationship with wafer 26 and insert 44 during the various stages of the release of the wafer from the polishing head. It will be understood that other elements of the polishing head, such as the polishing head illustrated in FIG. 11, cooperate with carrier 34 to accomplish the release as described hereinafter.

Figure 15:
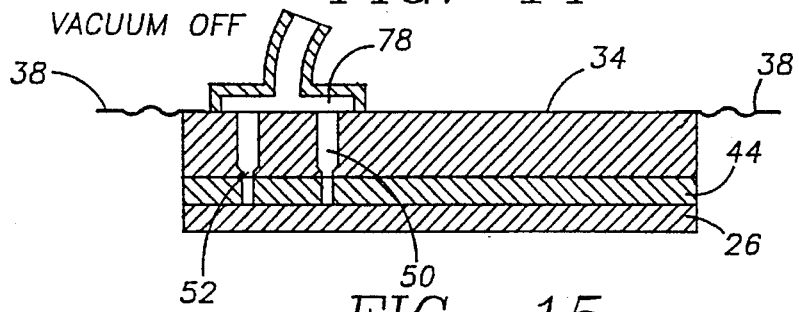

The wafer is released from the carrier by removing the vacuum from vacuum source 86 at control valve 84 as shown in FIG. 15. Preferably a positively pressurized fluid such as a gas or a liquid, or a combination of pressurized air 130 and water 132 are communicated via first rotary union 104 to chamber 78 where it is applied via fluid transport channels 50 to holes 52 to assist in the release. The positive pressure overcomes any residual holding force between the wafer and the attachment surface and thereby provides a more reliable release of the wafer from the carrier.

The use of water 132 during the release process is particularly advantageous because it also clears the fluid transport channels 50, holes 52, and attachment surface 40 of polishing residues such as polishing slurry, and prepares the surface for receipt of the next wafer. When water is used, deionized or distilled water is preferred to reduce or eliminate the deposit of minerals within the channels and pores. When a combination of water 132 and pressurized air 130 are used, the water is introduced into polishing head 72 first so that water will be forced out first to clean the channels and holes.

Figure 16:
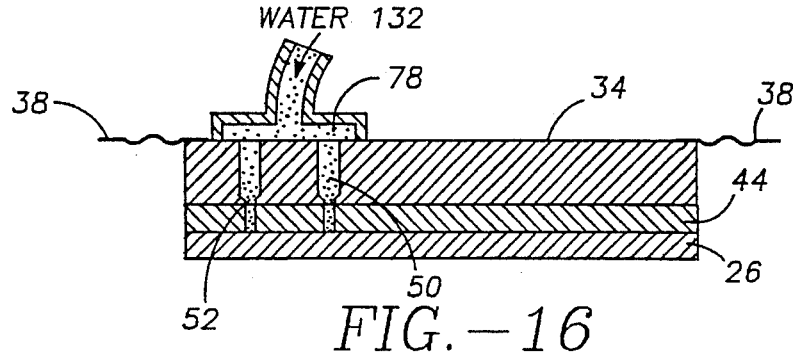
Figure 17:
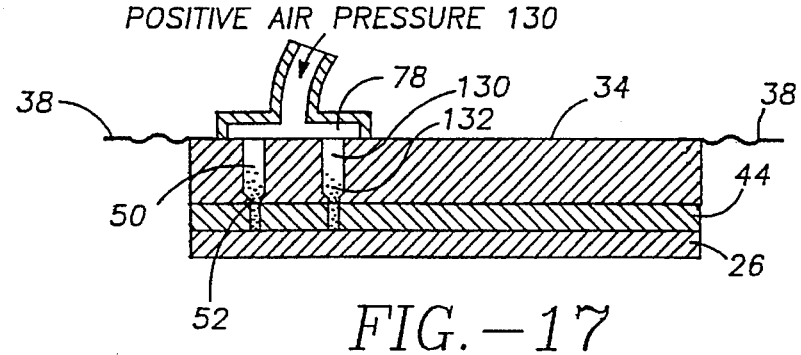
Figure 18:
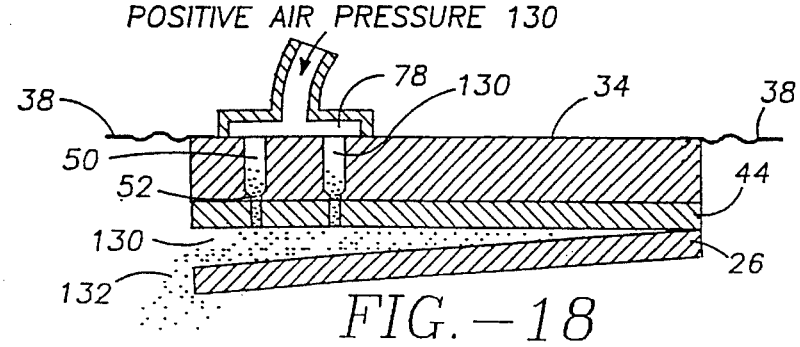

In one embodiment, deionized water at a pressure of between about 5 psi and about 25 psi (typically about 10 psi) is introduced for between about 2 seconds and about 20 seconds (typically about 5 seconds) as shown in FIG. 16, so that an appropriate volume of water 132 is introduced into the device. Then pressurized air 130 is introduced as shown in FIG. 17–18, to force the water out of holes 52 thereby releasing the wafer from the attachment surface and cleaning the channels and holes of polishing residue as shown in FIG. 18. Between about 20 cubic centimeters (cc) and about 500 cc of water, more typically between about 90 cc and about 120 cc of water, are introduced into the device prior to application of pressurized gas; however, the amount of water 132 needed will depend on the characteristics of the device, including the volumes of the chamber and channels, and the area of the attachment surface. Therefore, greater or lesser volumes of water may be used for particular applications.

The compressible nature of the air 130 allows a higher water pressure to be developed within chamber 78 than with relatively noncompressible water 132 alone, thereby ejecting the water at a higher velocity and with greater turbulence to clean holes 52 (and insert holes 60) than with pressurized gas or water alone. The pressurized air 130 is applied even after water 132 has been expelled in order to remove water from the channels and holes. Removal of water from within the chamber, channels, and holes of the carrier and polishing head is important since it is believed that the presence of water or other liquid diminishes the strength of the vacuum force that can be developed at the holes 52.

It will be seen from the above description that the invention includes a method for releasing a wafer face from a polishing surface. The method may be practiced in connection with a polishing apparatus having a polishing surface for polishing one of a pair of opposed faces of a wafer, where the one wafer face is planar and oriented during polishing parallel to and in substantial contact with the polishing surface. An attachment adapted to be mounted to the polishing apparatus so as to permit an attachment surface defined by the apparatus to tilt relative to the polishing surface should be provided. The attachment surface should be configured to mate with two regions of the wafer. The attachment is mounted to the polishing apparatus, or may be a part thereof.

When the wafer is to be released from the polishing pad, the attachment surface, such as a surface of a wafer carrier, is mated with the wafer. The mating of the attachment surface occurs with two regions of the wafer, each wafer region to be subjected to a different adhesive force. Then, an adhesive force is defined between the attachment surface and one of the wafer regions, and a second adhesive force is concurrently defined between the attachment surface and the other of the wafer regions. The second adhesive force is different than that defined between the attachment surface and the one region so as to cause a non-parallel relationship between the one wafer face and the polishing surface. Then the attachment surface is moved in a manner that causes the attachment surface (with the adhered wafer) to separate from the polishing surface so that release and separation of the one wafer face from the polishing surface is facilitated. The movement of the attachment surface is generally a movement perpendicularly away from the polishing pad.

Another embodiment of the method of the invention comprises the optional step of imparting a mechanical lifting force on one side of the attachment surface. When such a lifting force is applied, it is applied in the region where the stronger adhesive force has been defined so that the combination of the stronger adhesive force and the mechanical lifting force preferentially lifts that region of the wafer first.

The method may also comprise other optional steps that provide for releasing the wafer and cleaning the channels and holes of polishing residues so that wafers may be reliably adhered when a vacuum adhesive force is used. These optional steps comprise delivering a positively pressurized fluid having a pressure higher than the surrounding ambient pressure to the attachment surface. A single fluid, such as air or other gas, may be used for releasing the wafer. However, the use of both a liquid (e.g. water) and a gas (e.g. air) provides release and cleaning of the polishing residues.

As mentioned at the beginning of the detailed description, applicants are not limited to the specific embodiment(s) described above. Various changes and modifications can be made. The claims, their equivalents and their equivalent language define the scope of protection.

All publications and patent applications cited in this specification are herein incorporated by reference as if each individual publication or patent application were specifically and individually indicated to be incorporated by reference.

What is claimed is:

1. A device for use with a polishing apparatus having a polishing head and a polishing surface for polishing one face of a pair of opposed faces of a wafer, said one wafer face being oriented during polishing generally parallel to, and in substantial contact with, said polishing surface, said polishing head being movable to relocate said polishing head toward said polishing surface when polishing said wafer and away from said polishing surface when said polishing is terminated, said device comprising the combination of:

an attachment adapted to be mounted to said polishing head of said polishing apparatus so as to permit an attachment surface defined by the same to tilt relative to said polishing surface, which attachment surface is configured to mate with at least two regions of said wafer each located on only one side of an imaginary line bisecting said one face of said wafer not bisecting one of said two regions; and first means for developing a first adhesive force between said attachment surface and a first one of said wafer regions; and second means for developing a second adhesive force between said attachment surface and a second one of said wafer regions, said first adhesive force being a higher magnitude force than said second adhesive force developed between said attachment surface and said second region so as to cause differential adhesion between said wafer face and said attachment surface proximate said first and second wafer regions wherein said first region is held more forcefully to said attachment surface than said second region;

said differential adhesion facilitating preferential separation of said one wafer face from said polishing surface proximate said first region on said opposed face when said polishing head is moved away from said polishing surface by adhering said first region of said wafer with greater force.

2. The device in claim 1, wherein said one wafer face is generally planar.

3. The device in claim 1, wherein said second means for developing a second adhesive force between said attachment surface and the second one of said wafer regions causes a generally non-parallel relationship between said one wafer face and said polishing surface.

4. The device in claim 1, wherein both of said regions are on the other one of said pair of opposed faces of said wafer, whereby differential adhesive force on said two regions of another face results in facilitating separation of the other one of said faces from said polishing surface.

5. The device in claim 1, wherein said means for developing an adhesive force between said attachment surface and said other region includes directing means for directing a vacuum provided by a vacuum source to said other of said regions.

6. The device in claim 1, wherein both of said regions are on the face of said wafer opposed to said one face; and said means for developing an adhesive force between said attachment surface and said other region includes directing means for selectively directing a vacuum provided by a vacuum source which otherwise might be applied to both of said regions to said other of said regions to the exclusion of said one region.

7. The device in claim 6, wherein said attachment is a carrier for a wafer flexibly mounted to said polishing apparatus; and said directing means for selectively directing the vacuum includes a pressure chamber coupled to said vacuum source, and a plurality of fluid transport channels extending from said pressure chamber to said attachment surface.

8. The device in claim 7, wherein said fluid transport channels open within a limited region of said attachment surface.

9. The apparatus in claim 8, further comprising a flexible membrane coupling said carrier to said polishing apparatus.

10. The apparatus in claim 9, further comprising means for exerting a mechanical force to separate one portion of said carrier from said polishing surface while another portion of said carrier remains in contact with said polishing surface.

11. The apparatus in claim 10, wherein said means for exerting a mechanical force comprises at least three lifting rods adapted to engage said carrier so as to cause a non-parallel relationship between said attachment surface and said polishing surface.

12. The apparatus of claim 11, further comprising:

fluid delivery means for delivering at least one fluid having a pressure higher than the surrounding ambient pressure to said attachment surface.

13. The apparatus in claim 12, wherein said fluid delivery means delivers said pressure over said limited region of said attachment surface and includes a plurality of fluid transport channels which open within said limited region of said attachment surface.

14. The apparatus in claim 8, further comprising means for sensing the presence of a wafer on said attachment surface.

15. The apparatus in claim 14, wherein said means for sensing the presence of a wafer includes a sensor channel extending from said pressure chamber to said attachment surface which opens within a region of said attachment surface outside of said limited region.

16. A device for use with a polishing apparatus having a polishing head and a polishing surface for polishing one face of a pair of opposed faces of a wafer, said one wafer face being oriented during polishing generally parallel to and in substantial contact with said polishing surface, said polishing head being movable to relocate said polishing head toward said polishing surface when polishing said wafer and away from said polishing surface when said polishing is terminated, said device comprising the combination of:

a carrier for a wafer adapted to be mounted to said polishing head of said polishing apparatus so as to permit an attachment surface defined by said carrier to tilt relative to said polishing surface, which attachment surface is configured to mate with at least two regions on the other one of said pair of opposed faces of said wafer each located on only one side of an imaginary line bisecting said one face of said wafer not bisecting one of said two regions;

first means for developing a first adhesive force between said attachment surface and a first one of said wafer regions; and second means for developing a second adhesive force between said attachment surface and a second one of said wafer regions, said first adhesive force being a higher magnitude force than said second adhesive force developed between said attachment surface and said second region so as to cause differential adhesion between said wafer face and said attachment surface proximate said first and second wafer regions wherein said first region is held more forcefully to said attachment surface than said second region is held to said attachment surface;

said second means for developing a second adhesive force between said attachment surface and said second wafer region includes directing means for selectively directing a vacuum provided by a vacuum source which otherwise might be applied to both of said regions to said second region to the exclusion of the first region;

said differential adhesive force on two regions of another face results in facilitating preferential separation of the other one of said faces to be polished from said polishing surface proximate said first region on said opposed face when said polishing head is moved away from said polishing by adhering said first region of said wafer with greater force.

17. The device in claim 16, wherein said one wafer face is generally planar.

18. The device in claim 16, wherein said second means for developing a second adhesive force between said attachment surface and a second one of said wafer regions causes a generally non-parallel relationship between said one wafer face and said polishing surface.

19. A device for use with a polishing apparatus having a polishing head and a polishing surface for polishing one face of a pair of opposed faces of a wafer, said one wafer face being oriented during polishing generally parallel to and in substantial contact with said polishing surface, said polishing head being movable to relocate said polishing head toward said polishing surface when polishing said wafer and away from said polishing surface when said polishing is terminated, said device comprising the combination of:

a flexible fluid impermeable membrane;

a carrier for a wafer coupled to said polishing head by said flexible membrane and defining an attachment surface configured to mate with a first region of said wafer on the other one of said pair of opposed faces of said wafer;

means for forming a first pressure differential between two volumes on opposite sides of said flexible membrane to cause said carrier to exert a polishing force against said polishing surface during polishing in proportion to said pressure differential; and means for forming a second pressure differential between a volume adjacent to a region of said attachment surface and another volume and for directing an adhesive force caused by said second pressure differential to said wafer in proportion to said second pressure differential;

whereby a polishing pressure may be exerted by said means for forming a first pressure differential and separation of said wafer face from said polishing surface is facilitated by said means for forming a second pressure differential.

20. The device in claim 19, wherein said one wafer face is generally planar.

21. The device in claim 19, wherein said means for forming a first pressure differential comprises:

a sealed chamber defined between said flexible fluid impermeable membrane and another portion of said polishing apparatus not in fluid communication with said carrier attachment surface;

a pressurized fluid source coupled to said sealable chamber; and a control valve for controlling the flow of pressurized fluid from said pressurized fluid source into said sealed chamber;

wherein said carrier defines said attachment surface further configured to mate with a second region of said wafer on the other one of said pair of opposed faces of said wafer; and wherein said means for forming a second pressure differential comprises:

first means for developing a first adhesive force between said attachment surface and said first one of said wafer regions; and second means for developing a second adhesive force between said attachment surface and said second one of said wafer regions, said first adhesive force being a higher magnitude force than said second adhesive force developed between said attachment surface and said second region so as to cause differential adhesion between said wafer face and said attachment surface proximate said first and second wafer regions wherein said first region is held more forcefully to said attachment surface than said second region is held to said attachment surface;

said second means for developing a second adhesive force between said attachment surface and said second wafer region includes directing means for selectively directing a vacuum provided by a vacuum source which otherwise might be applied to both of said regions to said second region to the exclusion of the first region;

said differential adhesive force on two regions of another face results in facilitating preferential separation of the other one of said faces to be polished from said polishing surface proximate said first region on said opposed face when said polishing head is moved away from said polishing by adhering said first region of said wafer with greater force.

22. A method for releasing a second face of a wafer having two opposed faces from attachment to a wafer polishing surface while maintaining attachment of the first opposed wafer face to a wafer attachment surface on a polishing head, said method comprising the steps of:

developing a first adhesive force between said attachment surface and one region of said first wafer face;

developing a second adhesive force between said attachment surface and a second wafer region of said first wafer face which is different than the force developed between said attachment surface and said first region so as to cause a differential in adhesive force between said first and second regions of said first wafer face and said attachment surface so that said first region is held more forcefully to said attachment surface than said second region, said first and second regions being located only one side of an imaginary line bisecting said one face of said wafer not bisecting one of said two regions;

said differential in adhesive force facilitating preferential separation of said second wafer face from said polishing surface proximate the region having the larger adhesive force when said polishing head is moved away from said polishing surface; and moving said attachment surface in a manner that causes said attachment surface to be separated from said polishing surface so that separation and release of said second wafer face from said polishing surface is facilitated.

23. The method in claim 22, wherein said first wafer face is generally planar.

24. The method in claim 22, wherein said steps of developing said first and second adhesive forces between said attachment surface and said first and second wafer regions causes a generally non-parallel relationship between said second wafer face and said polishing surface.

25. The method of claim 22, further comprising the step of imparting a mechanical lifting force to lift said attachment surface away from said polishing surface on one side of said attachment surface.

26. The method of claim 25, further comprising the step of delivering a positively pressurized fluid having a pressure higher than the surrounding ambient pressure to said attachment surface for releasing said wafer from said attachment surface.

* * * * *